US006271628B1

(12) United States Patent
Sugitani et al.

(10) Patent No.: US 6,271,628 B1
(45) Date of Patent: Aug. 7, 2001

(54) HIGH PRESSURE LAMP WITH SPECIFIC AMOUNT OF MERCURY, HALOGEN AND WALL LOADING

(75) Inventors: Akihiko Sugitani; Hiroto Sato, both of Himeji; Takashi Ito, Tatsuno; Yoshihiro Horikawa, Himeji, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/089,412

(22) Filed: Jun. 3, 1998

(30) Foreign Application Priority Data

Apr. 8, 1998 (JP) ..... 10-111316

(51) Int. Cl.[7] ..... H01J 61/12

(52) U.S. Cl. ..... 313/637; 313/639; 313/640; 313/641

(58) Field of Search ..... 313/637, 571, 313/639, 640, 641

(56) References Cited

U.S. PATENT DOCUMENTS 5,109,181 4/1992 Fischer et al. .
5,497,049 3/1996 Fischer .

FOREIGN PATENT DOCUMENTS 0 917 180 5/1999 (EP) .
46-21433 6/1971 (JP) .
49-5421 7/1974 (JP) .
5-144413 6/1993 (JP) .

*Primary Examiner*—Vip Patel
(74) *Attorney, Agent, or Firm*—Nixon Peabody LLP; David S. Safran

(57) ABSTRACT

A high pressure mercury lamp in which formation and spreading of milky opacification in the fused silica glass forming the discharge vessel can be advantageously prevented, and thus a rapid decrease of screen illuminance prevented, when it is used as the light source of a liquid crystal projector and the like by, in a high pressure mercury lamp in which a discharge vessel of fused silica glass contains a pair of opposed tungsten electrodes, mercury in an amount that is at least equal to 0.16 mg/mm$^3$, rare gas, and at least one halogen, and in which the wall load is at least equal to 0.8 W/mm$^2$, the amount of mercury added being fixed in a range from $2\times10^{-4}$ to $7\times10^{-3}$ $\mu$mole/mm$^3$, and/or the at least one halogen being in the form of a carbonless halogen compound, and/or the average OH radical concentration in an area of a wall of the discharge vessel at a depth of 0.2 mm from an inner surface of the wall of the discharge vessel being at most 20 ppm.

10 Claims, 3 Drawing Sheets

| AMOUNT OF MERCURY ADDED ($mg/mm^3$) | AMOUNT OF BROMINE ($\mu g$) | INSIDE VOLUME OF EMMISSION SPACE ($mm^3$) | AMOUNT OF HALOGEN ($\mu$ mol/$mm^3$) | STATE OF ARC TUBE | DEGREE TO WHICH ILLUMINANCE IS MAINTAINED (%) |
|---|---|---|---|---|---|
| 0.208 | 0.071 | 78 | $1.14 \times 10^{-5}$ | BLACKENING AND DEVITRIFICATION OF THE UPPER PORTION OF THE ARC TUBE | 30 |
| 0.192 | 0.750 | 72 | $1.20 \times 10^{-4}$ | BLACKENING OF THE UPPER PORTION OF THE ARC TUBE | 45 |
| 0.211 | 1.500 | 79 | $2.37 \times 10^{-4}$ | CLEAR | 70 |
| 0.200 | 3.100 | 75 | $5.17 \times 10^{-4}$ | CLEAR | 72 |
| 0.197 | 6.200 | 74 | $1.05 \times 10^{-3}$ | CLEAR | 80 |
| 0.213 | 11.000 | 80 | $1.72 \times 10^{-3}$ | CLEAR | 80 |
| 0.200 | 22.000 | 75 | $3.67 \times 10^{-3}$ | CLEAR | 70 |
| 0.197 | 44.000 | 75 | $7.34 \times 10^{-3}$ | BLACKENING OF THE BASE POINTS OF THE ELECTRODES | 65 |

FIG. 3

HIGH PRESSURE LAMP WITH SPECIFIC AMOUNT OF MERCURY, HALOGEN AND WALL LOADING

BACKGROUND OF THE INVENTION

1. Field of the Invention

The invention relates to a high pressure mercury lamp. The invention relates especially to a super high pressure mercury lamp in which a discharge vessel is filled with at least 0.16 mg/mm$^3$ of mercury, in which the mercury vapor pressure during operation is at least equal to 110 atm, and which is used to back light a liquid crystal display device or the like.

2. Description of the Related Art

In a liquid crystal display device of the projection type, there is a need for illumination of images on a rectangular screen in a uniform manner and with adequate color reproduction. Therefore, as the light source, a metal halide lamp is used which is filled with mercury and metal halides. The metal halide lamps have recently been made even smaller so that more and more they represent point light sources. Metal halide lamps with an extremely small distance between the electrodes are used in practice.

Proceeding from this background, instead of metal halide lamps, recently lamps have been suggested with an extremely high mercury vapor pressure which is, for example, at least equal to 200 bar (roughly 197 atm). Here, by increasing the mercury vapor pressure, spreading of the arc is suppressed (concentrated), and furthermore, there is an effort to increase light intensity even more. These lamps are disclosed, for example, in Japanese patent disclosure document HEI 2-148561 and corresponding U.S. Pat. No. 5,109,181, and Japanese patent disclosure document HEI 6-52830 and corresponding U.S. Pat. No. 5,497,049.

In U.S. Pat. No. 5,109,181, a high pressure mercury lamp is disclosed in which a discharge vessel provided with a pair of tungsten electrodes is filled with a rare gas, at least 0.2 mg/mm$^3$ of mercury, and a halogen in the range from $1\times10^{-6}$ to $1\times10^{-4}$ $\mu$mole/mm$^3$. This lamp is operated with a wall load that is at least equal to 1 W/mm$^2$. The reason for adding an amount of mercury at least equal to 0.2 mg/mm$^3$ is to improve color reproduction by increasing the mercury pressure and the continuous spectrum in the area of visible radiation, especially in the red range. The reason for a wall load that is at least equal to 1 W/mm$^2$ is the need for a temperature increase in the coolest portion in order to increase the mercury pressure. The reason for adding the halogen is to prevent blackening of the envelope; this can be obtained from the patent. However, the reason for fixing the amount of the halogen in the range from $1\times10^{-6}$ to $1\times10^{-4}$ $\mu$mole/mm$^3$ is not described. Furthermore, it is also described that the halogen is added in the form of methylene bromide ($CH_2Br_2$).

On the other hand, U.S. Pat. No. 5,497,049, it is described that, in addition to the above described amount of mercury, values of wall load, amount of halogen, the shape of the discharge vessel and the distance between the electrodes are fixed, and furthermore, bromine is used as the halogen. The reason for adding bromine is to prevent blackening of the envelope. When at least $10^{-6}$ $\mu$mole/mm$^3$ of bromine is added, a sufficient effect is obtained. Furthermore, it is shown that the electrodes are etched when more than $10^{-4}$ $\mu$mole/mm$^3$ of bromine is added. Furthermore, it is described that this lamp is suitable for a projector light source and that the degree to which illuminance of the screen of a liquid crystal projection television is maintained is better than in a conventional lamp.

However, based on the specifications disclosed in the above described prior art, a host of lamps was produced, installed in a liquid crystal projector and experiments were run with respect to the illuminance of the screen. As a result, it became apparent that, in reality, after operating the lamps for a few hundred hours, the illuminance of the screen was greatly reduced.

This reduction in the radiant light intensity was a result of milky opacification of part of the discharge vessel. Furthermore, the milky opacification increases quickly, once it has occurred in part of the discharge vessel. Formation and spreading of this milky opacification lead to blackening of the envelope, and furthermore, deformation and wear of the tip of the electrodes also occur. It was found that, by synergistic effects, a reduction of illuminance of the screen is caused.

In this case, the mechanism of formation of milky opacification in the discharge vessel and the spreading of resulting milky opacification is not entirely clear. As a result of the studies collected and checked by the inventors, however, the following is assumed.

In a discharge in a mixed gas of mercury vapor with an extremely high pressure, the amount of the mercury added being at least equal to 0.16 mg/mm$^3$, and the rare gas yields excimer light from mercury rare gas in a wavelength range between the rare gas excimer light and a mercury resonance line with a wavelength of 185 nm. If Ar, Kr, and Xe are used as the rare gas, rare gas excimer light is formed at wavelengths of roughly 126 nm, 146 nm and 172 nm, respectively. Since the mercury pressure is very high, the line width of the resonance line of the mercury atoms with a 185 nm wavelength becomes larger. The light intensity of the wavelengths which are shorter than the resonance line is intensified to a relative degree. At the same time, mercury rare gas excimer light is formed between the rare gas excimer light and the 185 nm wavelength light.

In this super high pressure mercury lamp, the excimer light is emitted extremely effectively by the rare gas (light with wavelengths of 126 nm, 146 nm, and 172 nm), as is the light with the wavelengths which are shorter than the resonance line of the mercury atoms with a 185 nm wavelength, and the mercury rare gas excimer light (hereinafter, this light is called "UV radiation with short wavelengths") in the band area of roughly 126 nm to 185 nm. This UV radiation with short wavelengths on the inside of the discharge vessel has extremely high irradiance because the wall load of the discharge vessel is high.

On the other hand, there is a tendency for the wavelength range in which absorption takes place by the fused silica glass which forms the discharge vessel to be shifted in the direction toward longer wavelengths when the temperature of the discharge vessel becomes high. In a high pressure mercury lamp with a high value of the wall load that is at least equal to 0.8 W/mm$^2$, the fused silica glass has a very high temperature by which the emitted UV radiation with short wavelengths is absorbed by the fused silica glass.

This means that, in a mercury lamp with an extremely high mercury vapor pressure and extremely high wall load, UV radiation with short wavelengths is emitted in an intensity which is not comparable to UV radiation with short wavelengths in a conventional mercury lamp, and this UV radiation with short wavelengths is in a state in which it is easily absorbed by the fused silica glass.

If the above described UV radiation with short wavelengths is absorbed by the fused silica glass, the bond of silicon (Si) to oxygen (O) which comprises the fused silica glass is destroyed, resulting in strain stress, and thus, a fundamental change of the surface composition of the fused silica glass surface. Irradiation with UV radiation with short wavelengths causes vaporization of the Si or SiO comprising the fused silica glass, and the Si or SiO is adsorbed on the immediately adjacent fused silica glass surface. In the case of a large amount of absorbed UV radiation with short wavelengths, therefore, on the fused silica glass surface fine convex or concave points form, presumably causing the milky opacification.

In this case, the amount of absorption of UV radiation with short wavelengths is relatively small in the state in which the fused silica glass surface is clean. However, there is a tendency for the amount of absorption to become greater, the more impurities are present. Therefore, it is desirable, during lamp operation; for control to be effected such that the inner surface of the fused silica glass has no impurities. However, for this reason, it is necessary to avoid, as much as possible, mixing substances which cause impurities in the discharge vessel during the lamp production process.

Here, carbon is a contaminating substance which can be especially difficult to handle because, in the lamp production environment, it exists in the form of different organic compounds.

When, in one part of the fused silica glass, milky opacification forms, the heat is absorbed by multipath reflection of the light which contains infrared radiation, resulting in the temperature of the milky opacified parts rising. As a result, the light absorbed by the fused silica glass shifts in the direction toward longer wavelengths, leading to even more acceleration of absorption of the UV radiation with short wavelengths by the fused silica glass. It can be imagined that, as a result, the formation of the fine convex or concave points is accelerated, and therefore, that the milky opacification quickly spreads.

Furthermore, Si or SiO vaporizes from the tube wall when the Si and O bond of the fused silica glass is destroyed by UV irradiation. The vaporized Si or SiO is adsorbed by electrode tips and reduces the melting point of tungsten; this causes deformation and wear of the electrode tips and blackening of the envelope by tungsten.

SUMMARY OF THE INVENTION

The primary object of the present invention is to devise a high pressure mercury lamp in which formation and spreading of milky opacification in the fused silica glass forming the discharge vessel can be advantageously prevented, and thus, a rapid decrease of screen illuminance is prevented when a high pressure mercury lamp is used as the light source of a liquid crystal projector and the like.

According to the invention, in a high pressure mercury lamp which has a discharge vessel of fused silica glass containing a pair of opposed tungsten electrodes and which contains an amount of mercury that is at least equal to 0.16 $mg/mm^3$, rare gas, and at least one halogen, and in which the wall load is at least equal to 0.8 $W/mm^2$, the noted object is achieved by fixing the amount of halogen added in the range of $2\times10^{-4}$ to $7\times10^{-3}$ $\mu mole/mm^3$.

In accordance with another aspect of the invention, in a high pressure mercury lamp in which a discharge vessel of fused silica glass contains a pair of opposed tungsten electrodes and an amount of mercury at least equal to 0.16 $mg/mm^3$, rare gas, and at least one halogen in the form of a halogen compound, and in which the wall load is at least equal to 0.8 $W/cm^2$, the noted object is achieved by using a carbonless halogen compound.

According to further aspect of the invention, in a high pressure mercury lamp in which in a discharge vessel of fused silica glass contains a pair of opposed tungsten electrodes and which an amount of mercury that is at least equal to 0.16 $mg/mm^3$, rare gas, and at least one halogen, and in which the wall load is at least equal to 0.8 $W/mm^2$, the noted object is achieved by the average OH radical concentration being no more than 20 ppm, in an area at a depth of 0.2 mm from the inner surface of the discharge vessel, by itself and in conjunction with the above-noted aspects of the invention.

Attainment of the object is further facilitated by mercury halide being used as the halogen compound, particularly if it is deposited on a component or portion of a component of the lamp.

Another factor that additionally contributes to attainment the object of the invention is for the amount of rare gas added to be at least equal to 5 kPa.

To achieve the object, i.e. for advantageous prevention of the formation and spread of the milky opacification of the tube wall of the discharge vessel, the following is proposed:

1. Reduction of the UV radiation with short wavelengths which reaches the surface of the tube wall (fused silica glass).
2. Reduction of the impurities which often absorb UV radiation with short wavelengths, concretely, reduction of the carbon.
3. Reformation of the fused silica glass in itself so that it has sufficient resistance to UV radiation with short wavelengths.

With regard to the first of the above-described manners by which the object of the invention is achieved, i.e., by adding at least one halogen in a stipulated amount, specifically $2\times10^{-4}$ to $7\times10^{-3}$ $\mu mole/mm^3$, by adding at least $2\times10^{-4}$ $\mu mole/mm^3$ halogen, the UV radiation with short wavelengths is advantageously absorbed by the halogen(s) from a corresponding halogen compound. Consequently, the amount of UV radiation with short wavelengths which reaches the surface of the tube wall (fused silica glass) of the discharge vessel is reduced. This means that formation and spreading of the milky opacification which occurs due to irradiation of the fused silica glass with UV radiation with short wavelengths and due to absorption of the UV radiation with short wavelengths can be advantageously prevented. Furthermore, because the amount of halogen added is not unlimited, but is held to no more than $7\times10^{-3}$ $\mu mole/mm^3$, deformation and wear of the electrodes which are caused by excess halogens can be reduced to an amount in which there is no effect in practice.

High pressure mercury lamps filled with at least one halogen in the above described quantitative range are known from many publications of the prior art (e.g., from Japanese patent disclosure document SHO 49-5421). In these conventional lamps, however, using the halogen cycle prevents so-called blackening caused by the tungsten which forms the electrodes being adsorbed on the inside of the discharge vessel (fused silica glass). On the other hand, with this invention, the halogen is added to the discharge vessel in order to absorb UV radiation with short wavelengths. Absorption of UV radiation with short wavelengths within the discharge vessel advantageously prevents UV radiation with short wavelengths from reaching the fused silica glass.

As was described above, this UV radiation with short wavelengths is formed by excimer light from the mercury-rare gas in a wavelength range between the rare gas excimer light and a mercury resonance line of 185 nm, upon discharge in the mixed gas of mercury vapor with an extremely high pressure and the rare gas. The discharge conditions of the mercury lamps described in the above-described documents of the prior art are used to advantageously absorb UV radiation with short wavelengths which forms under completely different conditions. Discharge conditions in the invention are specific:

the amount of mercury added is at least equal to 0.16 $mg/mm^3$;

the wall load is greater than or equal to 0.8 $W/mm^2$; and rare gas is added.

Advantageous absorption of UV radiation with short wavelengths which is formed under these specific conditions was not present at all in the prior art.

In the second of the above-described manners of achieving the object of the invention, the discharge vessel is filled with at least one halogen in the form of a carbonless halogen compound. In a conventional mercury lamp, the discharge vessel is filled with a carbon-containing halogen, such as methylene bromide ($CH_2Br_2$). The carbon content in the discharge vessel becomes greater. The UV radiation with short wavelengths is absorbed by adsorption thereof on the fused silica glass during lamp operation.

In the high pressure mercury lamp of the invention, however, the halogen in the form of a halogen compound containing no carbon, for example, in the form of mercury bromide and the like, is added to advantageously prevent absorption of the UV radiation with short wavelengths by carbon. Therefore, the absolute amount of carbon in the discharge vessel becomes less. The UV radiation with short wavelengths which is absorbed by the carbon adsorbed on the inside of the fused silica glass can therefore remain in a negligible range, even if a small amount of carbon is undesirably added to the discharge vessel in the lamp production process. Consequently, formation and spreading of milky opacification in the fused silica glass can be advantageously prevented.

In the high pressure mercury lamp according to the invention in which the average OH radical concentration at a depth of 0.2 mm from the inner surface of the discharge vessel is less than or equal to 20 ppm, the following state of affairs applies.

Milky opacification of the fused silica glass is caused by fine crystals growing due to rearrangement of the vitreous $SiO_2$. Crystallization occurs more frequently, the higher the temperature. Furthermore, vitreous $SiO_2$ reacts sensitively to impurities on the surface and spreads in the direction toward the inside of the fused silica glass by formation of crystal nuclei on this surface. The speed of crystal growth, in this case, is controlled by glass viscosity and is influenced by the degree to which oxygen is absent, the OH concentration, and the impurity content. This means that, for anhydrous fused silica glass containing less oxygen, the viscosity is higher than in anhydrous fused silica glass in which oxygen satisfies the stoichiometric ratio. Furthermore, the viscosity is also higher in glass with a low OH concentration.

In any case, the rate of spreading of devitrification at the same temperature is reduced. When impurities are added, the glass viscosity is reduced in most cases. With respect to aluminum, the glass viscosity is higher, the higher the ratio of the aluminum to the coexisting alkali, i.e. aluminum/(lithium+sodium+potassium). This means that the rate of crystal growth is reduced.

The amount of absorption of UV radiation with short wavelengths by this fused silica glass region can be greatly reduced by the average OH radical concentration in an area with a stipulated depth from the inner surface of the fused silica glass of the discharge vessel being less than or equal to a stipulated value. Reducing the OH concentration makes it possible to increase the fused silica glass viscosity. This makes it possible to limit the rate of inward spreading of milky opacification to a sufficient degree, even if milky opacification occurs on the inner surface of the fused silica glass. This means that resistance to UV radiation with short wavelengths is improved by fixing the OH radical concentration of the fused silica glass.

In the above described technology, as the emission metal, mercury in an amount at least equal to 0.16 $mg/mm^3$ is added and the wall load is greater than or equal to 0.8 $W/mm^2$. Under these conditions with extremely high pressure, UV radiation with short wavelengths is produced with high intensity. Proceeding from these circumstances, the formation of milky opacification of the fused silica glass by the high intensity UV radiation with short wavelengths is prevented and its growth reduced. This means that the invention relates to a super high pressure mercury lamp with the above described discharge conditions. Therefore, in this case, it is not a matter of fixing the OH concentration throughout the fused silica glass of the discharge vessel, but rather fixing the OH concentration in a limited portion of the inner surface of the fused silica glass. To achieve the object of the invention, fixing the average OH radical concentration throughout the fused silica glass is not important.

By both fixing the amount of halogen added as described above and also fixing the OH radical concentration as also described, the addition of a stipulated amount of halogen reduces the UV radiation with short wavelengths reaching the fused silica glass, while by fixing the OH radical concentration of the fused silica glass, the resistance of the fused silica glass is improved.

By adding the halogen as a compound which contains no carbon the absolute amount of carbon within the discharge vessel can be reduced and furthermore efforts are made to improve the resistance of the fused silica glass by fixing the OH radical concentration.

Because the amount of carbon added in the discharge vessel can be reduced, as a result, the amount of absorption of UV radiation with short wavelengths by the fused silica glass can be greatly reduced, and thus, milky opacification of the fused silica glass can be advantageously prevented.

The mercury halide attracts very little moisture. Therefore, the content of water mixed in the discharge vessel can be reduced. Therefore, this results in the advantage that, when starting the discharge, there is no adverse effect on the electrodes. Furthermore, in the process of hermetic sealing, in the case of a discharge vessel without an exhaust tube, the heated lamp components are prevented from reacting with methylene bromide and the $SiO_2$ is prevented from being adsorbed on the electrodes and from exerting adverse effects on the starting power. As a result deformation and wear of electrodes can be reduced even more.

By the mercury halide being deposited on a component or a portion of a component of the lamp and added to the discharge vessel jointly with this component, in this way, compared to conventional addition as a solid powder, a small discharge vessel can be filled with the halogen with higher precision. Specifically, this measure is extremely effective in the case where the inside volume of discharge vessel is no more than 150 $mm^3$. Electrodes are suitable as the lamp components for deposition. This is because the electrodes are components which are inserted into the discharge vessel, and thus, the deposits on them also project into the discharge space. However, the components are not limited to electrodes, and the halogen compound, for example, can also be added to the discharge vessel by deposition on the inside surface of the discharge vessel and the like.

By the rare gas added having a pressure at least equal to 5 kPa and adding the mercury in an amount by which high pressure can be reached during operation, the light intensity can be increased even more, and at the same time, the continuous spectrum can be increased in the visible radiation range, especially in the red range. To start the discharge, however, rare gas is needed. In the high pressure mercury lamp of the invention, the amount of mercury added is large. When the lamp is turned off there are, therefore, many cases in which the mercury collects on the base points of the electrodes. If the discharge is started in this state, no discharge is generated between the electrode tips. Discharge always occurs more frequently in such a way that the base points of the electrodes are radiance spots. If this abnormal discharge occurs, the tungsten vaporizes or sprays by sputtering, causing blackening of the inner surface of the discharge vessel. The lamp of the invention has an extremely high wall load; this corresponds to a small area of the tube wall. Blackening accordingly occurs vigorously. However, if the pressure of the rare gas is fixed at a value at least equal to 5 kPa, discharge occurs more often between the electrode tips, the discharge gap being shortest between the electrode tips. Thus, abnormal discharge no longer occurs, and the above described problem is thus eliminated.

According to the invention, the formation and spread of milky opacification of the fused silica glass by UV radiation with short wavelengths, which occurs by adding a large amount of mercury and rare gas are prevented. For example argon, xenon and krypton are used as the rare gas. To obtain the aforementioned advantage, the amount of rare gas added is preferably at least equal to 5 kPa.

In the following, the invention is further described using several embodiments shown in the drawings.

BRIEF DESCRIPTION OF THE DRAWINGS

FIG. 3 is a table of experimental results which show the action of the invention.

DETAILED DESCRIPTION OF THE PREFERRED EMBODIMENT

Figure 1:
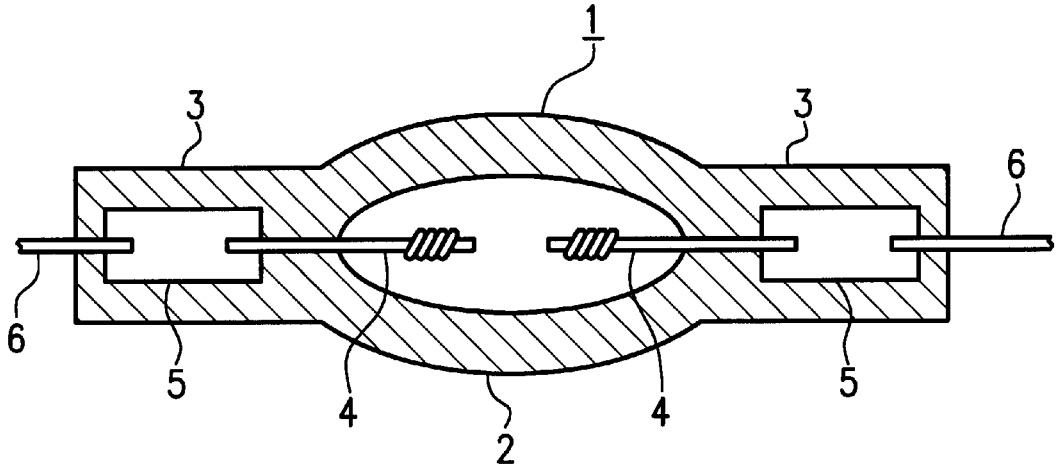
FIG. 1 is a cross section of a high pressure mercury lamp according to the invention.

FIG. 1 shows a high pressure mercury lamp 1 in accordance with the invention having a fused silica glass discharge vessel 2 in the center and narrow hermetically sealed portions 3 which adjoin opposite ends of discharge vessel 2. Within the interior of the discharge vessel 2, which is hereinafter called the "emission space," there are a pair of electrodes 4 that are spaced about 1.2 mm from one another. The rear (outer) ends of the electrodes 4 are inserted into the hermetically sealed portions 3 and are each welded to a respective metal foil 5. An outer lead 6 is connected to the opposite end of each of the metal foils 5.

The emission space is filled with mercury as the emission substance and a rare gas, such as argon, xenon and the like, as the operating starting gas. The rare gas is also an emission substance which emits mercury excimer light in steady-state operation. Here, the amount of mercury added is at least equal to 0.16 mg/mm$^3$, by which the vapor pressure during stable operation is at least equal to 110 atm.

This high pressure mercury lamp, for example, has a maximum outside diameter of 10.5 mm, a maximum inside diameter of 4.5 mm, an emission space length (the length in the axial direction of the lamp) of 10.0 mm, an amount of mercury added of 17 mg, an inside volume of the emission space of 75 mm$^3$, an inside surface of the emission space of 100 mm$^2$, a wall load of 1.5 W/mm$^2$, and a rated power of 150 W.

Figure 2:
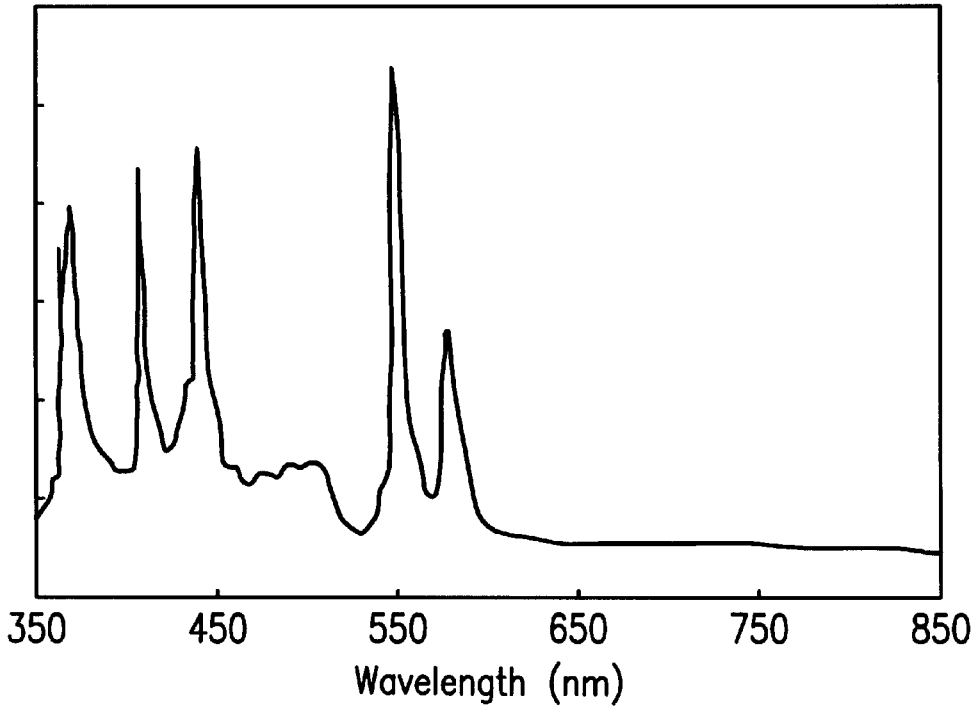
FIG. 2 is a graph of the spectral distribution of the high pressure mercury lamp of the invention.

FIG. 2 schematically shows the spectral distribution of the above described example of the high pressure mercury lamp. As the drawings show, effective radiation takes place in the visible range with wavelengths of about 380 to 780 nm. Especially in the red range with wavelengths from about 600 to 780 nm, continuous radiation takes place with high intensity which was greatly increased compared to a lamp with an added amount of mercury of no more than 0.05 mg/mm$^3$.

In the following, an experiment is described with respect to screen illuminance, in the high pressure mercury lamp of the invention, the amount of added halogen having been changed. In the experiment, as illustrated in FIG. 3, eight high pressure mercury lamps were used and only the amount of halogen (bromine) added was changed, the other conditions being essentially identical to the values in the above described example. This means that the amount of mercury and the inside volume of the emission space are very slightly different in the respective lamps. These differences are, however, only production defects, and any lamp in the visible range accomplishes advantageous continuous radiation.

In this case, the halogen (bromine) was added as follows:

The required amount of halogen (bromine) was vacuum evaporated in the form of mercury bromide onto the electrode surfaces on the sides of the secondary seal before installation. Furthermore, the amount added in reality was quantitatively determined using ion chromatography by the column enrichment process. The inside volume of the emission space was determined by immersion in a solvent with an index of refraction roughly equal to the index of refraction of the fused silica glass, and the coordinates of the inner surface being read by a micrometer and a computation performed.

Each discharge lamp was operated without interruption with a mode "2 hours and 45 minutes of operation and then 15 minutes off." By visually observing the discharge vessel at certain time intervals, and by a projector optics system, the degree to which illuminance is maintained was measured.

FIG. 3 shows the result of visual observation of the discharge vessel after 100 hours and the degree to which illuminance is maintained after 2000 hours. This shows that when the amount of halogen added is does not exceed $1.2\times10^{-4}$ $\mu$mole/mm$^3$, after 100 hours, in the upper portion of the discharge vessel blackening and devitrification could be seen and that, after 2000 hours, the degree to which illuminance is maintained was largely reduced to at most 50%. When $7.34\times10^{-3}$ mmole/mm$^3$ of halogen are added, after 100 hours, blackening to an extremely high degree was detected at the base points of the electrodes.

It can also be taken from these results that, to prevent formation of blackening and devitrification in the discharge vessel, a certain amount of halogen should be added and that the lower limit of the amount of halogen added is advantageously specifically about $2.0\times10^{-4}$ $\mu$mole/mm$^3$. As the light source for a liquid crystal projector, it is a good idea to maintain at least 50% of the irradiance for at least 2000 hours. In television use, there is a need for 10,000 hours. It becomes apparent that, to satisfy these conditions, the amount of halogen added must be greater than or equal to the above described value of the lower boundary.

When the amount of halogen added becomes greater, no problems of blackening and devitrification of the discharge vessel and decrease of screen illuminance occur. However, in the vicinity of the base points of the electrodes, adsorption of tungsten occurs to an extremely high degree. This means that, to prevent this adverse effect, it is preferred that the amount of halogen added is at most about $7.0\times10^{-3}$ $\mu$mole/mm$^3$.

In the following, an experiment is described in which formation and spreading of milky opacification of the fused silica glass are prevented by the OH radical concentration.

Figure 4:
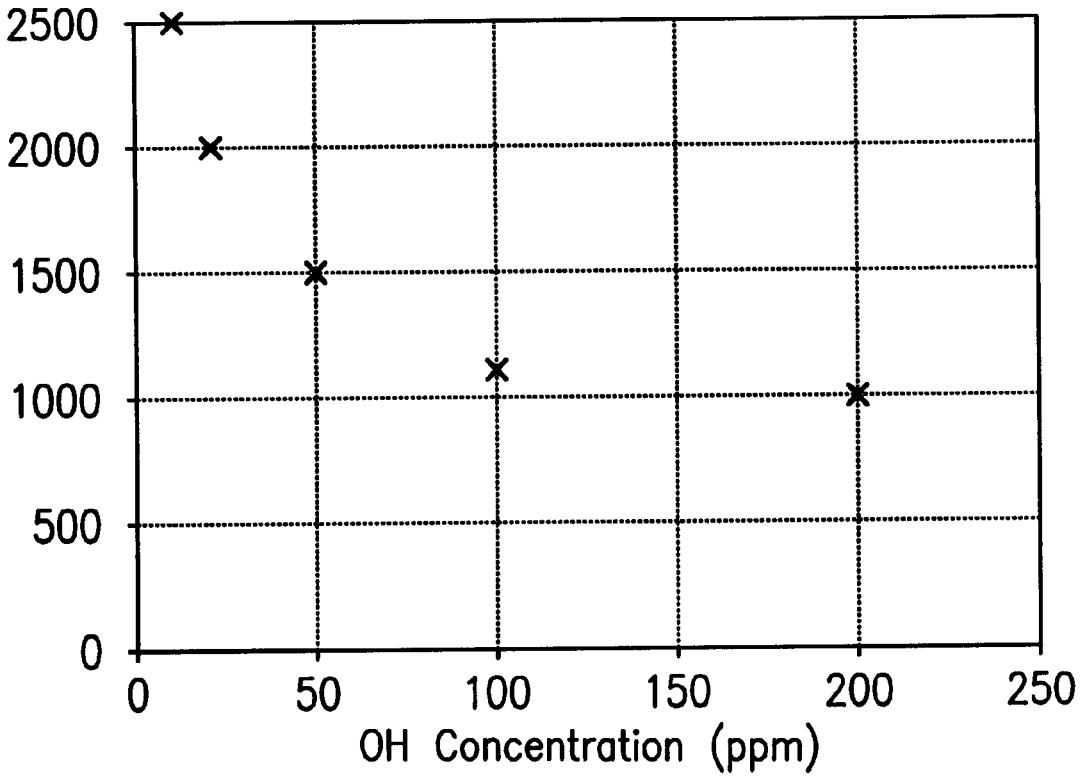
FIG. 4 is a graph of experimental results which show the action of the invention.

In the experiment, five super high pressure mercury lamps were produced with the above described specification, the OH radical concentration in a portion which has a depth of 0.2 mm proceeding from the inside surface of the fused silica glass was changed to 200 ppm, 100 ppm, 50 ppm, 20 ppm and 10 ppm, and the amount of the halogen that was added was $1\times10^{-3}$ $\mu$mole/mm$^3$. In each discharge lamp, the time was measured for which milky opacification of the fused silica glass exceeded 20% of the surface area of the entire inside of the emission space of the discharge vessel. FIG. 4 shows the result in which the y-axis plots the time for which the milky opacified portion of the fused silica glass has reached 20% of the surface area of the inside surface of the arc tube of the discharge vessel, while the x-axis plots the OH radical concentration. The figure shows that, at an OH radical concentration of at most 20 ppm in a portion which has a depth of 0.2 mm from the inside surface of the fused silica glass, the time of 2000 hours which is necessary for a liquid crystal projector is maintained.

The high pressure mercury lamp of the invention is not limited to DC and AC operating systems, and can be applied to any operating system.

Action of the Invention

As was described above, with the invention, in a high pressure mercury lamp in which in a discharge vessel of fused silica glass contains a pair of opposed tungsten electrodes, an amount of mercury which is at least equal to 0.16 mg/mm$^3$, rare gas, and at least one halogen, and in which the wall load is greater than or equal to 0.8 W/cm$^2$, the following actions are obtained:

1. By the feature that the amount of halogen added is in the range from $2\times10^{-4}$ to $7\times10^{-3}$ $\mu$mole/mm$^3$, UV radiation with short wavelengths can be advantageously absorbed by this halogen or the halogen from a corresponding halogen compound. Therefore, the amount of UV radiation with short wavelengths which reaches the surface of the tube wall (fused silica glass) of the discharge vessel by irradiation can be greatly reduced.
2. By the feature that the halogen is added as a compound which contains no carbon, the amount of carbon added to the discharge vessel can be greatly reduced. In this way, it becomes possible to reduce the amount of UV radiation with short wavelengths which is absorbed by the inside surface of the tube wall (fused silica glass) of the discharge vessel.
3. The measure that the average OH radical concentration in an area of the tube wall at a depth of 0.2 mm from the inner surface of the discharge vessel is at most 20 ppm enables the viscosity of the fused silica glass to be increased. Consequently, the resistance of the fused silica glass to UV radiation with short wavelengths can be improved.

What we claim is:

1. High pressure mercury lamp having a discharge vessel of fused silica glass containing a pair of opposed tungsten electrodes, mercury in an amount at least equal to 0.16 mg/mm$^3$, rare gas and at least one halogen, and in which a wall load is at least equal to 0.8 W/mm$^2$; wherein the amount of said at least one halogen in the discharge vessel is within the range of $2\times10^{-4}$ to $7\times10^{-3}$ $\mu$mole/mm$^3$.

2. High pressure mercury lamp as claimed in claim 1, wherein at least 5 kPa of rare gas is contained within the discharge vessel.

3. High pressure mercury lamp as claimed in claim 1, wherein said at least one halogen is in the form of a carbonless halogen compound.

4. High pressure mercury lamp as claimed in claim 3, wherein said halogen compound is mercury halide.

5. High pressure mercury lamp as claimed in claim 4, wherein the mercury halide is in the form of a layer deposited at least a portion of a component of the lamp.

6. High pressure mercury lamp as claimed in claim 3, wherein at least 5 kPa of rare gas is contained within the discharge vessel.

7. High pressure mercury lamp as claimed in claim 3, wherein the average OH radical concentration in an area of a wall of the discharge vessel at a depth of 0.2 mm from an inner surface the wall of the discharge vessel is at most 20 ppm.

8. High pressure mercury lamp as claimed in claim 7, wherein at least 5 kPa of rare gas is contained within the discharge vessel.

9. High pressure mercury lamp as claimed in claim 1, wherein the average OH radical concentration in an area of a wall of the discharge vessel is at most 20 ppm.

10. High pressure mercury lamp as claimed in claim 9, wherein at least 5 kPa of rare gas is contained within the discharge vessel.

* * * * *